United States Patent [19]

Cecchi et al.

[11] 4,253,639

[45] Mar. 3, 1981

[54] DISTRIBUTOR DEVICE FOR HYDRAULIC CIRCUITS

[75] Inventors: Carlo F. Cecchi, Turin; Rino O. Barbagli, Borgaretto, both of Italy

[73] Assignee: Fiat-Allis Macchine Movimento Terra S.p.A., Lecce, Italy

[21] Appl. No.: 118,409

[22] Filed: Feb. 4, 1980

Related U.S. Application Data

[63] Continuation of Ser. No. 906,470, May 17, 1978, abandoned.

[51] Int. Cl.[3] ..... F16K 31/12; F16K 31/44

[52] U.S. Cl. ..... 251/44; 251/263

[58] Field of Search ..... 137/596.14, 868, 636, 137/636.2; 91/461, 522, 523; 251/251, 263, 37, 43, 44

[56] References Cited

U.S. PATENT DOCUMENTS

| | | | |
|---|---|---|---|
| 1,959,811 | 5/1934 | Brady et al. | 251/263 |
| 2,815,921 | 12/1957 | Bigelow | 251/43 |
| 3,161,137 | 12/1964 | Thoma et al. | 251/263 |
| 3,204,926 | 9/1965 | Wismar | 251/44 |
| 3,304,633 | 2/1967 | Hein et al. | 91/522 |
| 3,598,359 | 8/1971 | Rich | 251/44 |
| 3,613,716 | 10/1971 | Hoheisel | 251/44 |
| 3,862,738 | 1/1975 | Stumpneier | 251/44 |
| 3,977,301 | 8/1976 | Kroth et al. | 91/412 |

FOREIGN PATENT DOCUMENTS

| | | | |
|---|---|---|---|
| 2142698 | 8/1971 | Fed. Rep. of Germany | 251/44 |

*Primary Examiner*—Alan Cohan
*Assistant Examiner*—A. Michael Chambers
*Attorney, Agent, or Firm*—Robert A. Brown

[57] ABSTRACT

A hydraulic distribution manifold used to effect coupling of various hydraulic circuits and which includes at least one slidable valve spool whose movement is controlled by means of a crank mechanism operatively connected to a cam supported within the manifold and having at least two working surfaces for controlling movement of associated linkage.

8 Claims, 5 Drawing Figures

DISTRIBUTOR DEVICE FOR HYDRAULIC CIRCUITS

This is a continuation of application Ser. No. 906,470, filed May 17, 1978, and now abandoned.

BACKGROUND OF THE INVENTION

This invention relates in general to control mechanisms for hydraulic circuits and, in particular, to a valve system selectively actuable in response to movement of a control member.

More specifically, but without restriction to the particular use which is shown and described, this invention relates to a control system for controlling the flow of hydraulic fluid to hydraulic motors in response to movement of a control member which may be retained in predetermined positions to effect and maintain fluid communication of hydraulic circuits.

Hydraulic circuits are utilized in many applications to effect movement or operation of various hydraulically driven mechanical equipment. In certain of such applications, for example construction machinery or earth-moving equipment, hydraulic circuits are utilized to control and effect movement of such things as dozer blades, loading buckets and other various attachments or accessories. These hydraulic circuits are utilized to control various positions of the dozer blade such as pitch, tilt and doze to enable various functions to be performed with the machine.

During operation a machine operator controls such functions by actuation of control levers to effect fluid communication of various hydraulic circuits to actuate hydraulic motors effecting such blade movement. Since the machine operator is required to continuously use these control levers in order to actuate such machine accessories or auxiliary equipment, various attempts have been made to provide automatic actuation features whereby a single operation of a control lever will automatically effect a desired operation of the accessory equipment without having to continuously manually manipulate the levers. Such control systems greatly improve operator efficiency and safety by allowing the machine operator to effect a desired movement by placing the control lever into a fixed position thereby freeing the operator's hands from the controls for performing other operations. Examples of various hydraulic actuating mechanisms which are used to attain such dependent or interrelated movement are disclosed in H. E. Beck, U.S. Pat. No. 3,122,247 and J. S. Pilch, U.S. Pat. No. 3,155,253. Each of these patents discloses hydraulic circuits and mechanical linkage which permits the machine operator to effect semi-automatic operation of the accessory equipment through a single manipulation of a control lever.

While the systems described in these patents are designed to aid the machine operator, such systems are expensive and complex.

The present invention relates to a more simple and, therefore, reliable control system for maintaining fluid communication in a hydraulic circuit.

SUMMARY OF THE INVENTION

It is, therefore, an object of this invention to improve control systems for effecting fluid communication in hydraulic circuits.

Another object of this invention is to maintain the system control element which effects fluid communication in the hydraulic circuit in predetermined fixed positions.

A further object of this invention is to permit acutation of hydraulic circuits by movement of an actuator member into fixed positions to selectively maintain fluid communication in the hydraulic circuit.

These and other objects are attained in accordance with the present invention wherein there is provided a hydraulic distribution manifold used to effect coupling of various hydraulic circuits and which includes at least one slidable valve spool whose movement is controlled by means of a crank mechanism operatively connected to a cam supported within the manifold and having at least two working surfaces for controlling movement of associated linkage.

DESCRIPTION OF THE DRAWINGS

Further objects of the invention, together with additional features contributing thereto and advantages accruing therefrom will be apparent from the following description of a preferred embodiment of the invention which is shown in the accompanying drawings with like reference numerals indicating corresponding parts throughout, wherein.

DESCRIPTION OF THE PREFERRED EMBODIMENT OF THE INVENTION

Figure 1:
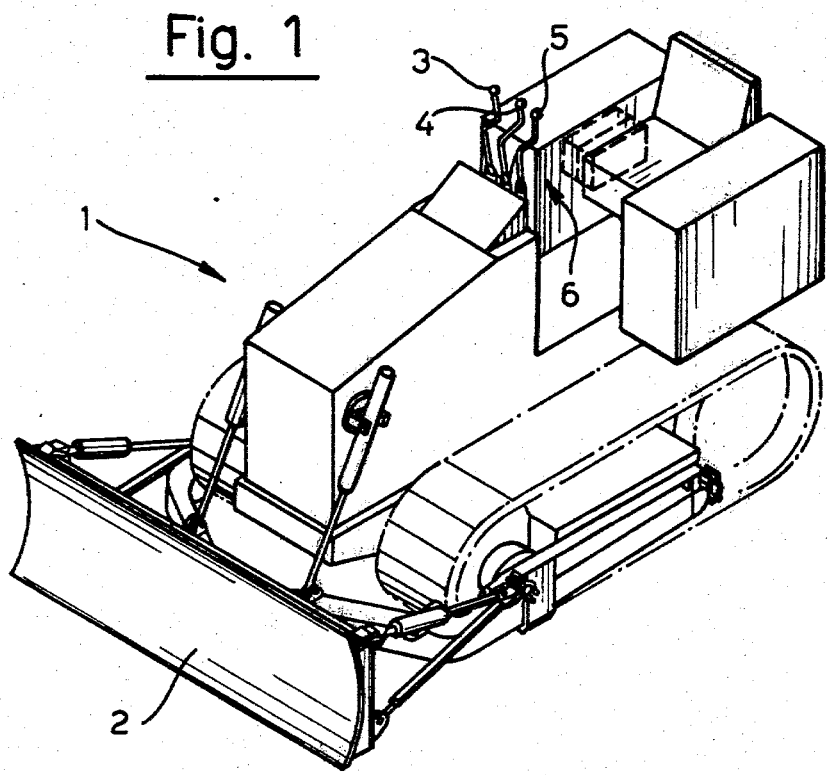
FIG. 1 is a front perspective view of a crawler tractor which utilizes the present invention.

Referring now to FIG. 1, there is shown an earth-moving machine 1, commonly referred to as a crawler tractor. The machine 1 is provided with a scraping or dozer blade 2, the movement of which is controlled by a machine operator through actuation of levers indicated as 3, 4, and 5. Movement of these control levers allows the machine operator to move valve spools in a distributor or manifold device 6 which serves to control and distribute the flow of hydraulic fluid through various hydraulic circuits controlling the movement and positioning of the scraper or dozer blade 2. The distributor or manifold 6 includes a casing or housing structure 7 in the form of an external casing in which control shafts 8, 9 and 10 are rota' bly supported within suitable bearing surfaces.

The internal portion of the housing 7 is formed with various conduits and chambers to allow hydraulic fluid or oil to circulate therethrough. While each of the control shafts 8, 9 and 10 extend outward of the housing 7, suitable seals are provided to prevent oil from flowing out of the manifold from around these shafts. The control shafts 8, 9 and 10 are each, respectively, connected to the control levers 3, 4 and 5 such that movement of the control levers will effect rotation of the control shafts to which the lever is connected. The ends of the control shafts 8, 9 and 10 which are carried inside the housing 7 are each connected to a crank arm indicated, respectively, as 8*a*, 9*a* and 10*a*. Each of these crank arms is coupled, respectively to a connecting rod 11, 12 and 13 each of which is connected to valve spools 14, 15 and 16. In this manner, movement of each of the control levers will rotate its respective control shaft which will move one of the spools 14, 15 or 16 through the crank arms and pin connected mechanical linkages. Movement of the spool of the slide valves 14, 15 and 16 is used to effect various fluid communications in the hydraulic circuits with which the spools are associated.

Figure 4:
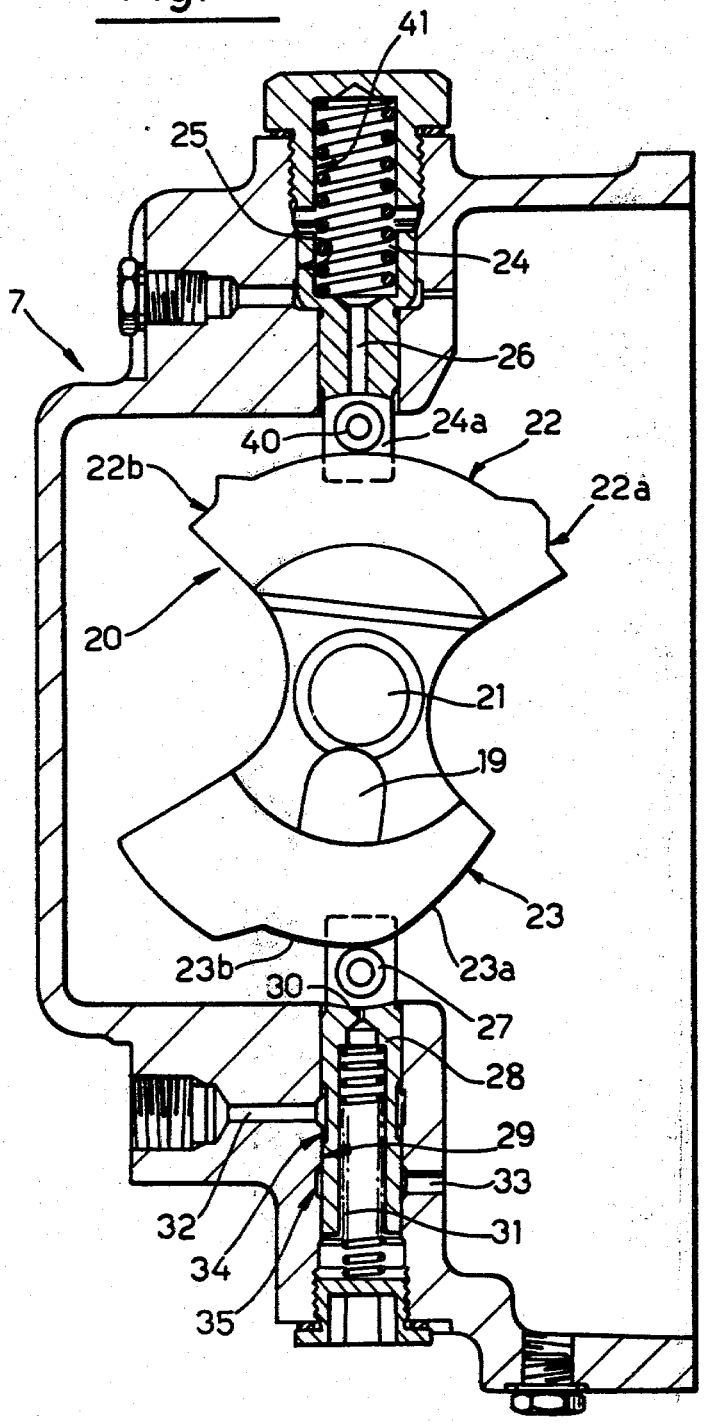
FIG. 4 is a cross sectional view of the apparatus shown in FIG. 2 taken along lines 4—4.

Referring to the control shaft 9, to which control lever 4 is connected, the crank arm 9*a* is formed with a bifurcated end portion to which the connecting rod 12 is attached by means of a pin 17 passing through the bifurcated portion of the crank arm 9*a* and the connecting rod 12. A portion 17*a* of the pin 17 projects outwardly and has a bearing 18 supported therein which engages a recessed portion or groove 19 in an auxiliary cam 20 for a purpose hereinafter to be described in detail. The cam 20 is rotably supported within the casing 7 upon a pin 21 secured to a portion of the housing. As best shown in FIG. 4, the cam 20 has two working surfaces 22 and 23, on opposed sides of the cam, such that rotation of the cam 20 about its pivot axis 21 will effect movement of followers 40 and 27 associated, respectively, in accordance with the working surfaces 22 and 23 of the cam.

Referring first to the working surface 23 of the cam 20, the surface 23 comprises two portions indicated by reference numerals 23*a* and 23*b* on the right and on the left side of a roller follower 27 in FIG. 4. The roller 27 is rotatably supported in the end of a piston 28 which is slidable within a chamber 29 to control fluid communication between a conduit 32 and a conduit 33. A small hole or metering bore 30 is formed in the end of piston 28 and functions as a damping element to control movement of the control lever 4 through the cam and associated mechanical linkage.

When the cam 20 is rotated in a direction clockwise from the neutral position shown in FIG. 4, the roller follower 27 moves along the surface 23*a* and the piston 28 will move outwardly from the chamber 29 due to the internal biasing force of an internal spring 31. In this manner, the piston 28 prevents or obstructs fluid communication between conduits 32 and 33 but would permit movement of the valve spool 15 through the connecting rod 12 to efffect fluid communication of hydraulic circuitry associated therewith.

When the machine operator acutates the control lever 4 effecting movement of the cam 20 in the other direction (counter-clockwise), the piston 28 is pushed downwardly inside chamber 29 through movement of the roller follower 27 over the cam surface. Because of the metering bore 30 formed in the end of piston 28, such movement of the control lever 4 is dampened to prevent over running or over controlling by the machine operator. After the control lever passes through its neutral position (shown in FIG. 4) movement or further rotation of the cam 20 in a counter-clockwise direction will cause the roller follower 27 to engage portion 23*b* of the cam surface.

Figure 5:
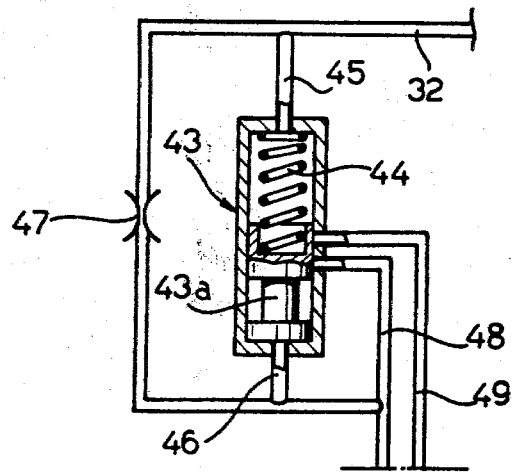
FIG. 5 is a hydraulic schematic to better illustrate the manner in which the control system is utilized in the hydraulic system of a crawler tractor such as shown in FIG. 1.
Figure 2:
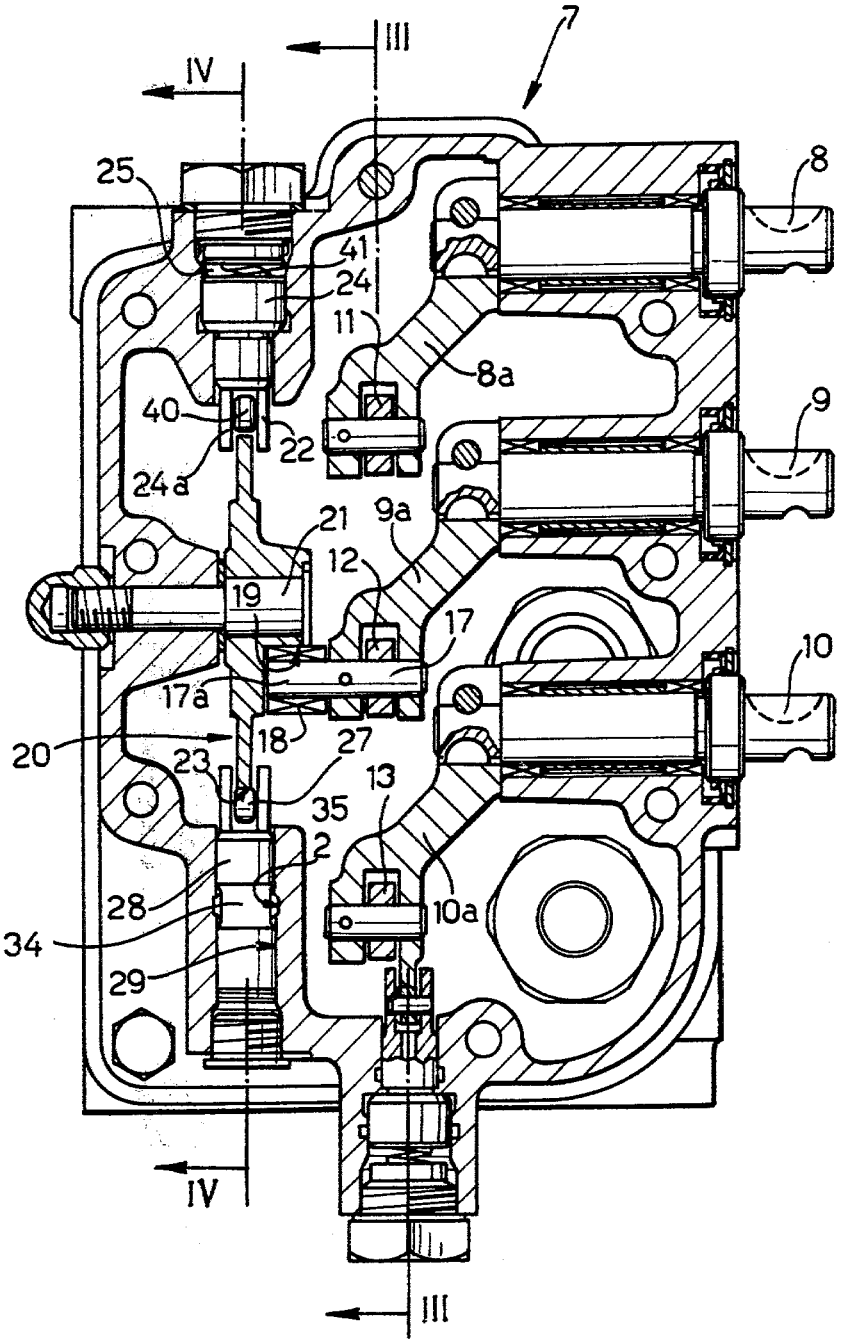
FIG. 2 is a cross sectional view of the hydraulic distribution manifold to better illustrate the internal portions thereof.
Figure 3:
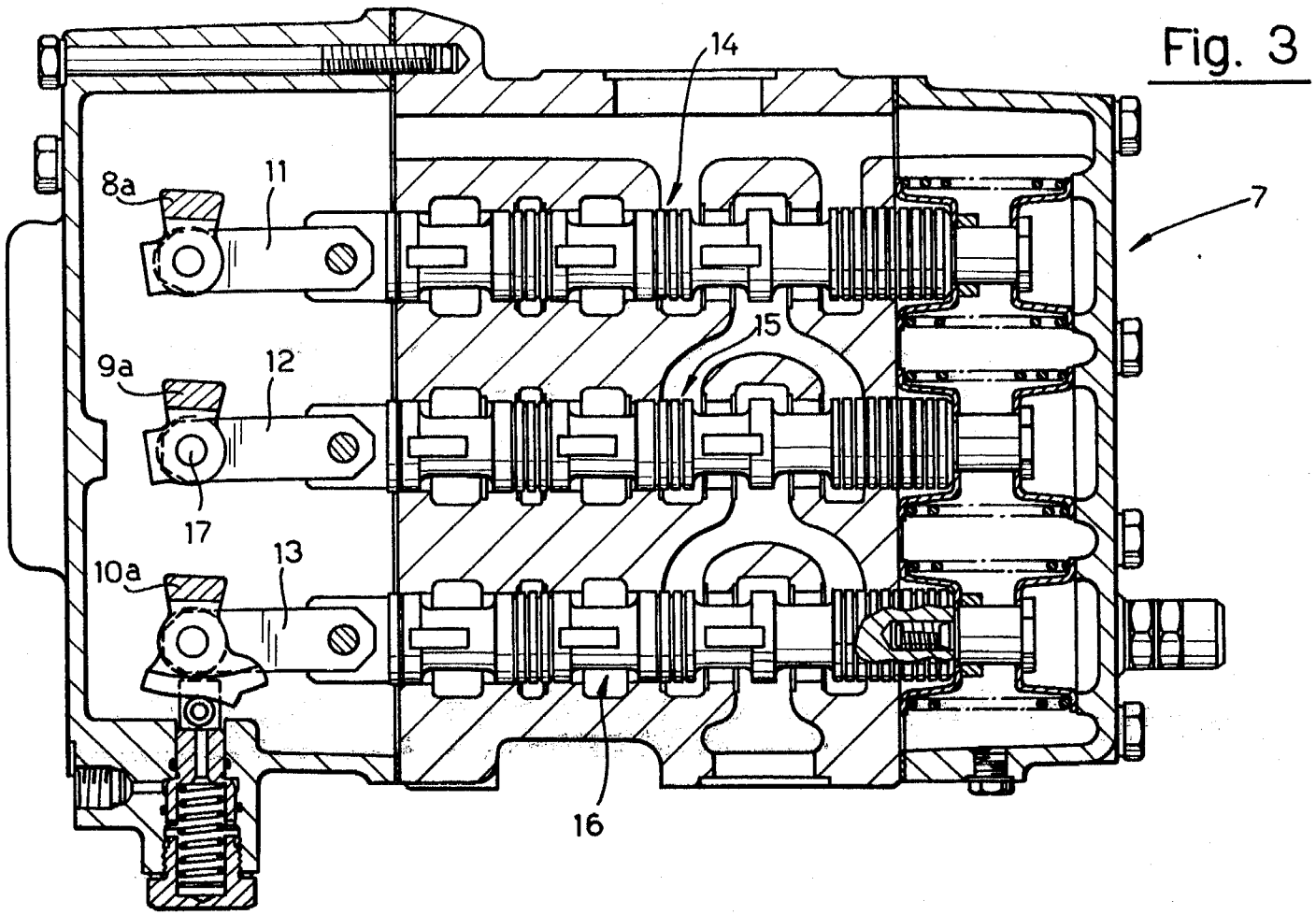
FIG. 3 is a cross sectional view of the apparatus shown in FIG. 2 taken along lines 3—3.

As the roller follower 27 engages the ramp portion of the 23*b* surface, the piston 28 will be depressed downwardly within the chamber 29 against the force of spring 31. When the roller passes over the ramp to the elevated portion of surface 23*b*, the displacement of piston 28 downwardly will effect fluid communication between conduit 32 and conduit 33 through suitable recesses 34 and 35 formed in the piston 28 and the internal walls of chamber 29, respectively. Fluid communication between the conduit 32 and 33 can then be utilized to effect movement of the spool of a slide valve as shown in the hydraulic schematic of FIG. 5, to be hereinafter described.

In order to hold the control lever 4 in a position for effecting the desired fluid communication without necessitating that the machine operator manually hold the control lever 4 in the position, the surface 22 of cam 20 is formed with a constant arcuate working profile having two detents 22*a* and 22*b*. The two detents 22*a* and 22*b* function to hold the cam 20 and associated linkage in a predetermined position when the cam is rotated to a position wherein a roller follower 40 passes over either of the detents thereby preventing the lever 4 from moving until the machine operator manually effects a change of position. The roller follower 40 is rotatably supported in the end 24*a* of a piston 24 which is carried within a chamber 25. An internal spring 41 biases the piston 24 outwardly into contact with the surface 22 of the cam 20. A passage 26 is provided through the piston 24 to allow oil to freely move through the piston during inward and outward movement within the chamber 25.

When the control lever 4 is operated by the machine operator to effect a desired fluid communication for various hydraulic circuitry, movement of the lever 4 will effect rotation of the cam 20. When the roller follower 40 passes over either of the detents 22*a* or 22*b*, depending upon the direction or rotation of the cam 20, the spring biasing force exerted by spring 41 against the piston 24 will maintain the control lever in a fixed position. At such time as the machine operator manually moves the control lever 4 thereby rotating the cam 20 to release the mechanism, the roller follower 40 will move over either of these two detents thereby releasing the control lever 4 from its predetermined position.

In this manner, and referring again to FIG. 5, the spool 43*a* of a distributor valve 43 can be placed in two different positions to effect fluid communication of various hydraulic circuits associated with the distributor valve and the earthmoving equipment. In a first position (illustrated in FIG. 5), the spool 43*a* obstructs fluid communication between two primary conduits 48 and 49 which, for example, could be coupled to a hydraulic motor for raising or lowering the lift cylinders assoxiated with the crawler tractor dozer blade.In a second position (not shown) the spool 43*a* is moved upwardly against the biasing force of an internal spring 44 to couple the two conduits 48 and 49 into fluid communication which could result, for example, in a lowering of the dozer blade 2. Positioning of the spool 43*a* is controlled by the pressure exerted through the two conduits 45 and 46 acting with the biasing spring 44. As shown, conduits 45 and 46 are in fluid communication with conduit 32. When the piston 28 is moved downwardly, effecting fluid communications between conduits 32 and 33, a difference in pressure is effected between conduits 45 and 46 due to a restrictor 47 in fluid communication between the two conduits 45 and 46. The restrictor 47 is effective to create a pressure differential between conduits 45 and 46 thereby permitting the valve spool 43 to be shifted between the two positions in response to hydraulic fluid flowing from the conduit 32 into the casing 7.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A hydraulic circuit control system for effecting fluid communication between a source of fluid pressure and apparatus actuable in response to the presence of fluid pressure comprising a control lever actuable into a position for effecting actuation of apparatus actuable in response to the presence of fluid pressure, valve means operatively connected to said control lever and movable in response to actuation thereof for effecting fluid communication between a source of fluid pressure and apparatus actuable in response to the presence of fluid pressure, cam means operatively connected to said control lever and interposed for rotational movement between said control lever and said valve means for effecting movement of said valve means in response to actuation of said control lever, said cam means having at least a first control surface, said at least first control surface operatively coupled to said valve means to move said valve means in response to the control surface thereof, distribution means operatively coupled to said valve means and responsive to said fluid communication for actuating the apparatus actuable in response to the presence of fluid pressure, said distribution means including means to create a pressure differential in response to said fluid communication, said distribution means further including a control member movable from a first position to a second position in response to said pressure differential for actuating the apparatus actuable in response to the pressure of fluid, said means to create a pressure differential including conduit means in fluid communication across said control member and valved by said valve means, first and second fluid conduits in fluid communication with said distribution means, said first fluid conduit including a first fluid conduit portion in communication with said means to create said pressure differential and further including a portion in communication with a portion of said control member and said control member acting to block fluid communication between said first and second fluid conduits in said first position and acting to effect fluid communication between said first and second conduits in said second position for actuating the apparatus, said valve means operable by said cam means to create said pressure differential to move said control member from said first to said second position.

2. The hydraulic system according to claim 1 wherein said means to create said pressure differential includes a restricted portion in said distribution means.

3. The apparatus of claim 1 wherein said cam means includes a second control surface, said second control surface forming a portion of retaining means for retaining said control lever in an actuated position.

4. The apparatus of claim 3 wherein said retaining means includes a roller follower carried on a piston which is spring biased into engagement with said second control surface.

5. The apparatus of claim 4 wherein said second control surface is formed as a constant radius arc with detents for engaging said roller follower to maintain said cam means in a stationary position determined by said detents.

6. The apparatus of claim 1 wherein said cam means is formed with a recessed portion for operative connection with said control lever to effect movement of said first and second control surfaces.

7. The apparatus of claim 1 wherein said valve means includes a piston having a roller follower supported on one end thereof and positioned to engage said first control surface for movement in response to the control surface to effect said fluid communication.

8. The apparatus of claim 7 wherein said piston is formed with a metering bore to dampen movement of said cam means.

* * * * *